US008998279B2

(12) United States Patent
Lloyd et al.

(10) Patent No.: US 8,998,279 B2
(45) Date of Patent: Apr. 7, 2015

(54) COMPACT HANDHELD ANIMAL WASTE COLLECTION TOOL WITH A BAG CARRYING CHAMBER

(76) Inventors: John D. Lloyd, Bethlehem, PA (US); Jonathan P Kessack, Tampa, FL (US)

( * ) Notice: Subject to any disclaimer, the term of this patent is extended or adjusted under 35 U.S.C. 154(b) by 383 days.

(21) Appl. No.: 13/283,567

(22) Filed: Oct. 27, 2011

(65) Prior Publication Data

US 2012/0104780 A1 May 3, 2012

Related U.S. Application Data

(60) Provisional application No. 61/407,818, filed on Oct. 28, 2010, provisional application No. 61/504,734, filed on Jul. 6, 2011.

(51) Int. Cl.
*A01K 29/00* (2006.01)
*E01H 1/12* (2006.01)

(52) U.S. Cl.
CPC ..... *E01H 1/1206* (2013.01)

(58) Field of Classification Search
CPC ..... A01K 29/00; A01K 23/00; A01K 23/005; E01H 1/12; B65D 33/00
USPC ..... 294/1.3–1.5, 176, 177; D30/162; 248/99, 100, 101; 119/795, 802; 383/33
See application file for complete search history.

(56) References Cited

U.S. PATENT DOCUMENTS 1,742,550 A 1/1930 Dimick
2,124,952 A 7/1938 Avery
3,777,708 A * 12/1973 Vogt ..... 294/1.5
3,819,220 A 6/1974 Bredt
3,998,415 A * 12/1976 D'Antonio et al. ..... 248/101
4,003,595 A * 1/1977 Fano et al. ..... 294/1.5
4,215,888 A * 8/1980 Gavin et al. ..... 294/1.3
4,428,610 A * 1/1984 Guffey ..... 294/1.3
4,466,647 A 8/1984 Spevak
4,705,310 A * 11/1987 Scripter ..... 294/1.4
4,776,129 A 10/1988 Kelly
4,852,924 A * 8/1989 Ines ..... 294/1.5
4,875,729 A 10/1989 Peck
4,900,077 A * 2/1990 Beck ..... 294/1.3
4,940,201 A * 7/1990 Kurth ..... 248/101
5,014,943 A * 5/1991 Nelson et al. ..... 248/99
5,290,080 A 3/1994 Yoshioka
5,497,580 A 3/1996 Vanderplaats
5,779,290 A * 7/1998 Wilke ..... 294/1.5
6,003,262 A 12/1999 Beaty
6,199,802 B1 * 3/2001 Scheibe, Sr. ..... 248/97
6,446,378 B1 9/2002 Welch
6,471,267 B2 10/2002 Asazuma
(Continued)

*Primary Examiner* — Paul T Chin
(74) *Attorney, Agent, or Firm* — Symbus Law Group, LLC; Clifford D. Hyra

(57) ABSTRACT

An animal waste collection tool has a body and a rotatable hoop connected to one end of the body that is rotatable between a folded and an extended position. A hoop-securing clip is attached to the body and secures the hoop in the extended or folded position. In the extended position the band forms an opening in which a bag is inserted for collection of unsanitary waste. The body is hollow and has a removable cover for inserting bags and a dispensing opening through which bags are removed. A clip on the body secures a bag inserted through the band. A bag is partially inserted through the band, secured to the clip, and pulled over the side of the band to cover it. Waste is collected in the bag, which pulls the bag through the band of material and leaves the bag hanging from the clip.

9 Claims, 18 Drawing Sheets

(56) References Cited

U.S. PATENT DOCUMENTS

| | | | | |
|---|---|---|---|---|
| 6,485,073 | B2 * | 11/2002 | Harrison | 294/1.4 |
| 6,554,335 | B1 * | 4/2003 | Kelly et al. | 294/15 |
| 7,287,790 | B1 * | 10/2007 | Kitiashvili | 294/1.4 |
| 7,325,849 | B2 | 2/2008 | Jones | |
| 7,407,207 | B2 | 8/2008 | Yilmaz | |
| D617,061 | S | 6/2010 | Su | |
| 2004/0119304 | A1 * | 6/2004 | Iso et al. | 294/1.3 |
| 2009/0152884 | A1 | 6/2009 | Ruscil et al. | |

* cited by examiner

COMPACT HANDHELD ANIMAL WASTE COLLECTION TOOL WITH A BAG CARRYING CHAMBER

This application claims the benefit of U.S. Provisional Application Nos. 61/407,818, filed Oct. 28, 2010, and 61/504,734, filed Jul. 6, 2011, which are hereby incorporated by reference in their entireties.

BACKGROUND

1. Field of the Invention

The present invention relates generally to tools used in the collection of pet waste and methods of collecting pet waste.

2. Description of Prior Art

Previously, animal waste has been collected by hand, with the hand inserted in a bag to avoid skin contact, or by various implements. However, these methods suffer from various drawbacks. Many devices and methods do not adequately prevent skin contact, leading to discomfort for the user and potential infection, involve contact between an implement and the waste, requiring cleaning of the implement and potentially resulting in secondary contamination of the user or other objects, require the user to touch or feel the waste through a barrier, which is distasteful, inconveniently require the user to transport and store bags separately from the implement, or are too large or cumbersome to easily transport under various conditions.

Consumer and commercial needs exists for improved tools and methods for collecting and handling pet waste.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description. In certain embodiments, the disclosed embodiments may include one or more of the features described herein.

A new compact, handheld pooper scooper tool has a bag carrying chamber. The tool allows for ease of portability while remaining clean throughout the process of picking up fecal matter. The tool is versatile in the manner in which it is transported. Its compact size allows for carrying in a pocket, on a leash via a leash carrying sleeve, or on the hip via a sport carrying sleeve or sport clip that can be attached to the tool.

In a new, sanitary animal waste collection method a container having an inside and an outside is partially inserted through a length of material, the container is secured to a fastener, the upper edge of the container is pulled over a side of the length of material and down so that a front of the length of material is covered by the outside of the container, and unsanitary waste is collected in the container, the unsanitary waste having a weight which pulls the upper edge of the container back through the length of material and leaves the container hanging from the fastener through the length of material.

In some embodiments, collecting unsanitary waste may include scraping the ground with the length of material, thereby pushing unsanitary waste on the ground into the container. In some embodiments, the length of material and fastener may be attached to a body. The length of material may be rotated away from the body to form an opening for insertion of the container. The length of material may be locked in an open or a closed position with a locking clip that the length of material extends through by mating the locking clip with the body. The length of material may be moved from a closed to an open position by sliding the locking clip along the length of material away from the body, rotating the length of material away from the body, sliding the locking clip down the length of the length of material towards the body, and securing the locking clip to the body.

In some embodiments, the length of material is extended outwards from the body to form an opening for insertion of the container. The extending the length of material may include sliding it out from grooved sides in the body.

A new sanitary animal waste collection apparatus includes a body and a hoop secured to the body and movable between an extended position and a compact position, where in the extended position the hoop extends outward from the body to form an opening in which a container can be inserted for collection of unsanitary waste and in the compact position the hoop is tight against the length of the body. In some embodiments, the body has a hollow interior for receiving a plurality of containers. The body may also include a removable cover that when removed allows the plurality of containers to be inserted in the interior of the body and a dispensing opening that allows the plurality of containers to be dispensed from the body without removing the cover.

In some embodiments, the opening is formed between the hoop and the body. In some embodiments, there is a fastener on the body for securing the container inserted through the hoop. In some embodiments, the hoop is secured to the body by pivots and is configured to rotate about the pivots between the extended position and the compact position. A hoop-holding clip may be attached to the body for holding the hoop in the extended or compact position. There may be a first locking structure on the body and a corresponding second locking structure on the hoop-holding clip that, when aligned, prevent easy movement of the hoop-holding clip. The hoop may extend through the hoop-holding clip.

In some embodiments, the body includes a grooved side, and the hoop is secured by the grooved side, and in the extended position the hoop extends outward from the grooved side. An end of the hoop may extend from the grooved side to the opposite side of the body. The opposite side of the body may be a second grooved side. In some embodiments, a slider member is attached to the hoop at one end, and the slider is configured for movement of the hoop back and forth within the grooved side and to prevent the hoop from completely exiting the grooved side. In some embodiments, the hoop in the extended position is arcuate and extends from the grooved side to the opposite side of the body.

These and other objectives and features of the invention are apparent in the disclosure, which includes the above and ongoing written specification.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art.

DETAILED DESCRIPTION

Figure 1:
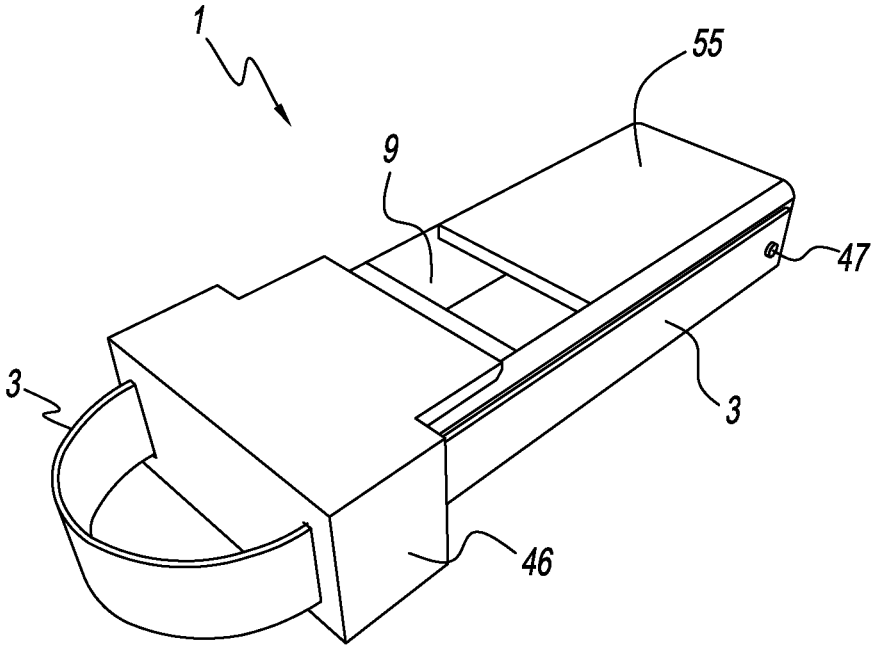
FIG. 1 is a top perspective view of a first embodiment of a handheld animal waste collection tool with a hoop in a closed position.

A compact handheld animal waste collection tool with a bag carrying chamber will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The figures are not to scale. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

A new handheld animal waste collection tool has a hollow, rectangular prism-shaped handle body into which bags can be inserted, for example through a removable cover, and from which bags can be removed, for example via a bag retrieval opening. A flexible hoop is connected to the body and configured to be positioned and locked in an open position, for operation, or in a closed position, for compact storage and transportation. When the flexible hoop is in the open, operating position, a bag is secured inside and overlapping the hoop. The bag may be secured in part by a clip, user finger or other fastener (such as a hook-and-loop fastener, adhesive, snap, or the like). The tool is then used to scrape animal waste off the ground and into the bag. The bag is configured such that it can be removed, closed, and discarded without the risk of contacting animal waste. In various embodiments, the hoop is configured for movement between open and closed positions in various ways.

In a first embodiment, illustrated in FIGS. 1-12, 43 and 44 a rotatable hoop lies flat along the side of the handle body. For use, the hoop extends and rotates open, forming an open ovular ring attached to the body. The hoop is rotatably attached to one end of the body and inserted through, and held in place by, a clip that wraps around the ends of the body. When the ovular hoop is extended, a bag is placed through the hoop, for example as described below with reference to FIGS. 26-29.

FIG. 1 is a top perspective view of a handheld animal waste collection tool 1 in a first embodiment with a rotatable hoop 3 in a closed position. Here, the rotatable hoop 3 is rotatably attached to a body 55 at 47 and is held in place by clip 46. The clip 46 conforms to the shape of the body 55, here a rectangular prism, so as to allow the body to slide into the clip up to the end wall. Protrusions 53 (FIG. 11) on one side of the clip 46 slide into notches 50 (FIG. 5) in the closed position to lock the clip in place, and into alternate corresponding notches 51 (FIG. 6) on the opposite side of the body when the hoop is in an open position. The hoop is inserted into rectangular holes 54 in the clip 46 (FIG. 12) which conform to the shape of the hoop and allow the clip to be slid along the hoop without being removed from the tool. This sliding of the clip puts the clip and hoop in position to rotate to the alternative open or closed positions.

Figure 2:
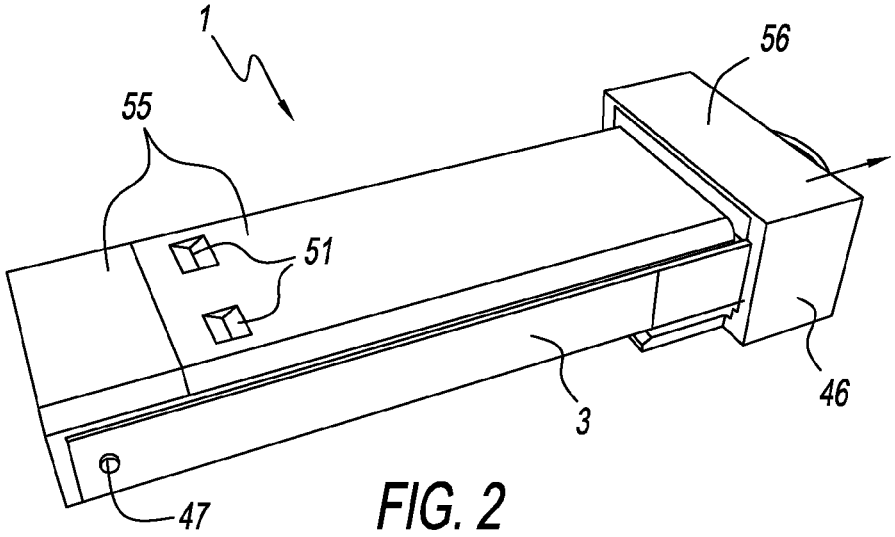
FIGS. 2-7 are perspective views of a first embodiment of a handheld animal waste collection tool transitioning from a closed and locked position to an open and locked position.
Figure 3:
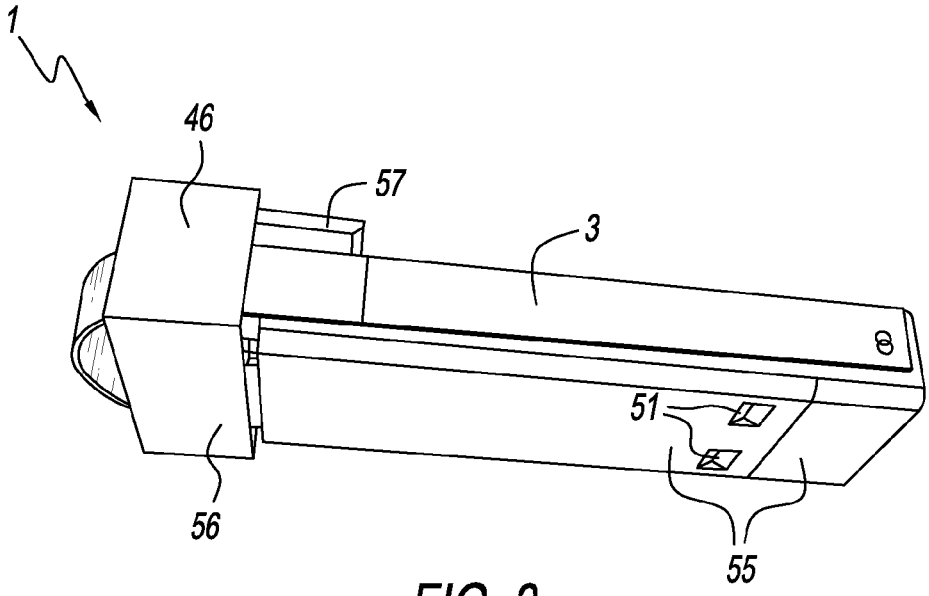
Figure 4:
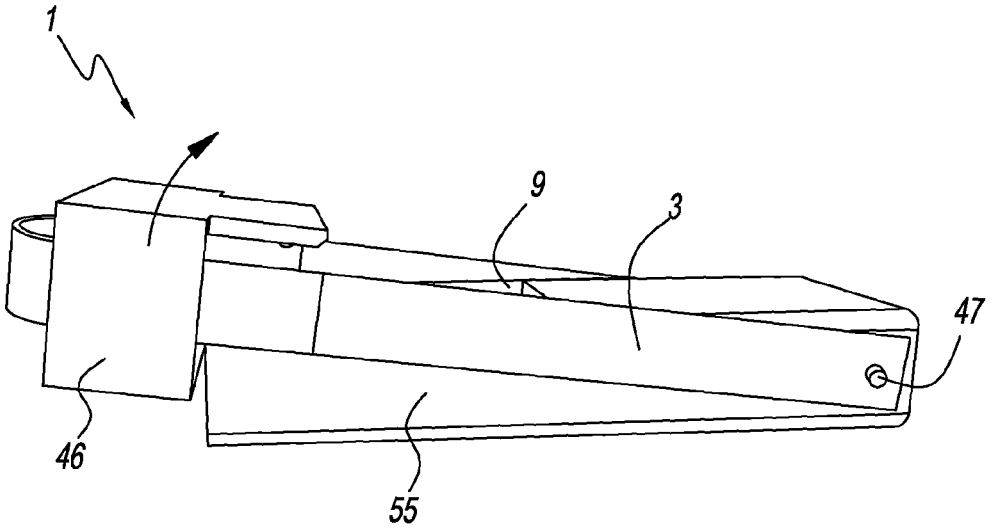
Figure 5:
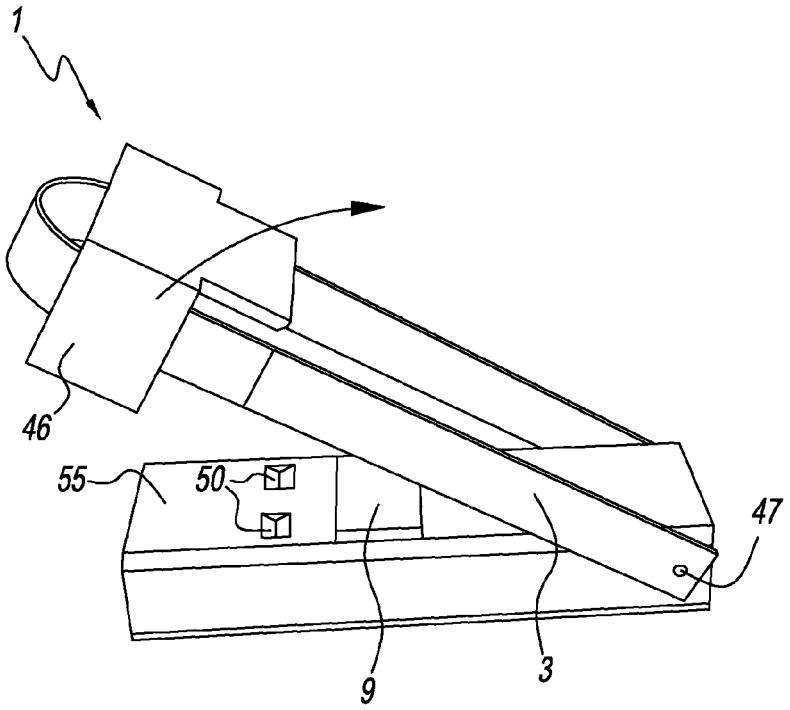
Figure 6:
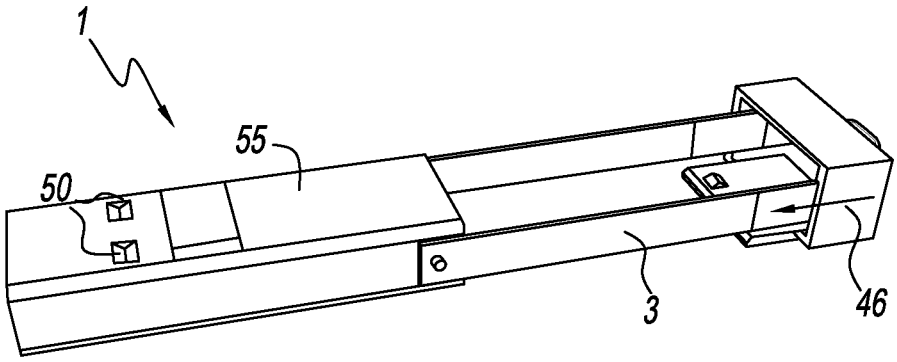
Figure 7:
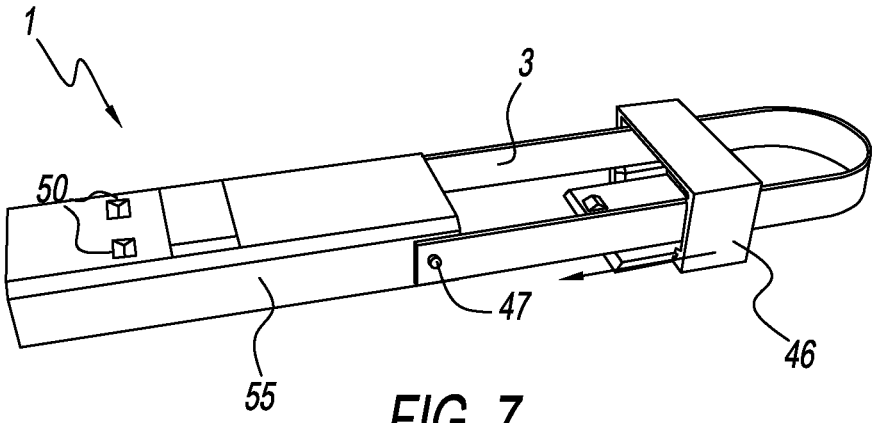
Figure 8:
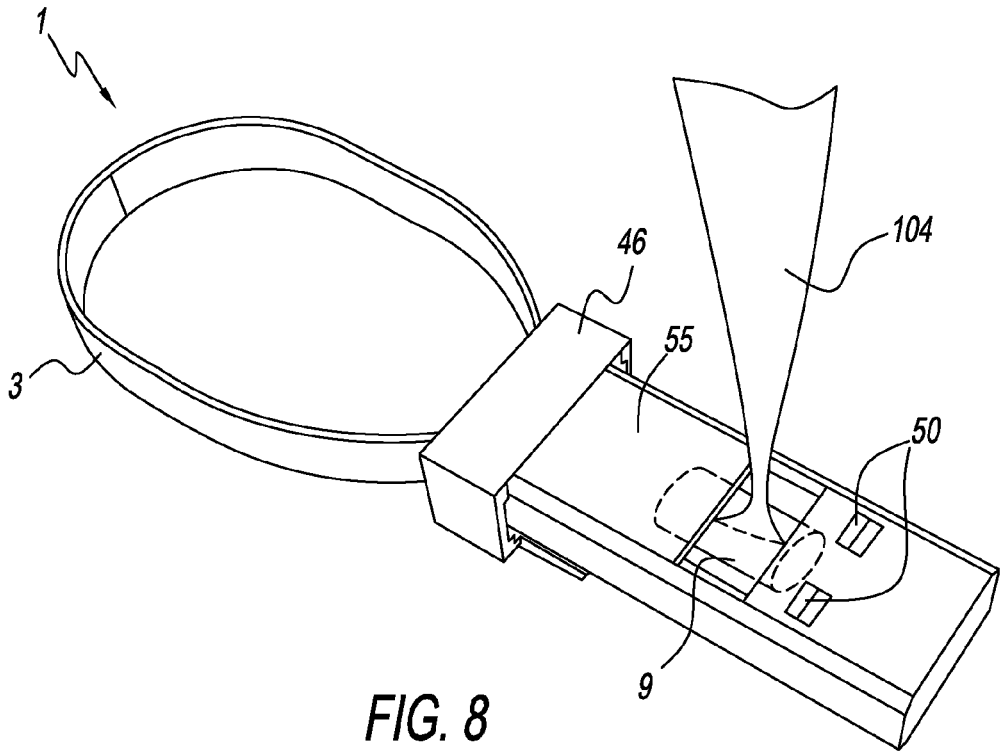
FIG. 8 is a top perspective view of a first embodiment of a handheld animal waste collection tool with a hoop locked in an open position.
Figure 9:
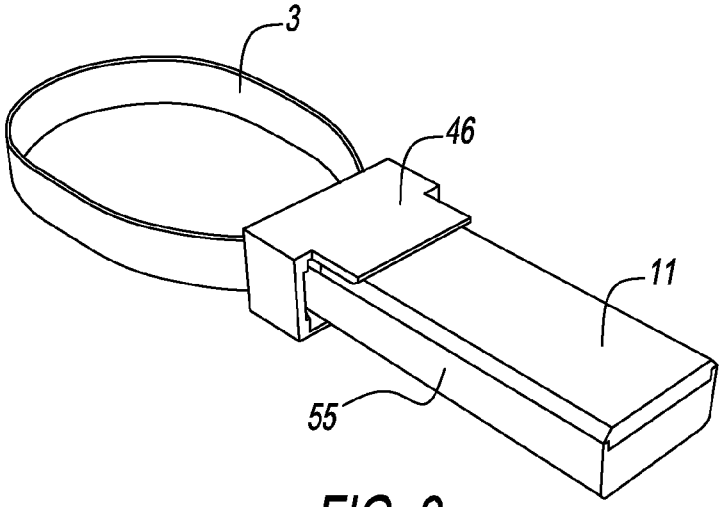
FIG. 9 is a bottom perspective view of a first embodiment of a handheld animal waste collection tool with a hoop locked in an open position.

FIG. 2 shows the clip 46 securing the hoop 3 in the closed position, with protrusions 53 (FIG. 11) in notches 50. By exerting a modest force on the clip 46 away from the body 55 of the tool, the protrusions 53 are dislodged from notches 50 and the clip 46 slides along the hoop 3 away from the body 55 of the tool far enough for the lower edge to clear the tool body as shown in FIGS. 3 and 4, allowing the hoop 3, and the clip 46 therewith, to be rotated 180 degrees into the open position as shown in FIGS. 4, 5 and 6. The clip 46 can then be slid the length of the hoop 3 as shown in FIG. 7 until the opposite end of the body is inserted into the clip 46 and the protrusions 53 slide into the alternate notches 51 to secure the hoop 3 in the open position as shown in FIGS. 8 and 9. FIGS. 3-7 show the process of moving clip 46 away from body 55, rotating it 180 degrees in conjunction with hoop 3, and then moving it back to the body 55 to clip it in the open position as depicted in FIG. 9.

FIG. 8 is a top perspective view of a handheld animal waste collection tool 1 in a first embodiment with a rotatable hoop 3 in an extended open position. Clip 46 is secured to the body 55 and holding hoop 3 in the open position. Dispenser 9 allows bags 104 to be withdrawn from the bag storage area inside the tool. Notches 50 are for securing the hoop clip 46 when in the compact position.

FIG. 9 is a bottom perspective view of a handheld animal waste collection tool 1 in a first embodiment with rotatable hoop 3 in the extended open position. Here, the bag compartment cover 11 is visible. Bags are inserted into the bag storage compartment after removing this cover 11.

Figure 10:
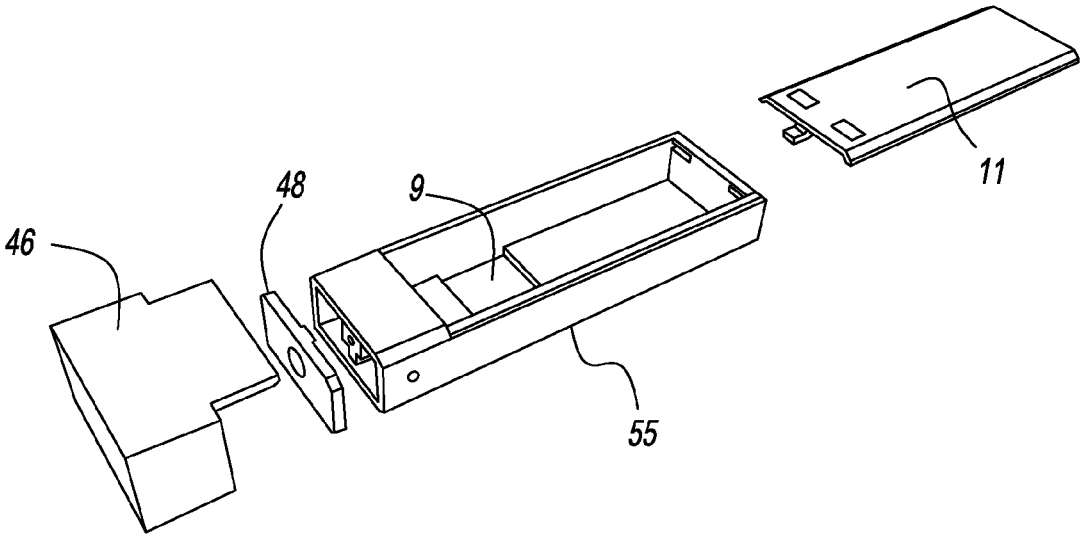
FIG. 10 is a perspective view of an exploded handheld animal waste collection tool in a first embodiment utilizing a rotating hoop showing the body, bag compartment cover, end cover, and hoop holding clip.

FIG. 10 is a perspective view of an exploded handheld animal waste collection tool in a first embodiment utilizing a rotating hoop showing the body 55, bag compartment cover 11, end cover 48, and hoop holding clip 46. In this embodiment, the tool is assembled from four separate components, the hoop-holding clip 46, end cover 48, main body 55 and bag cover 11.

Figure 11:
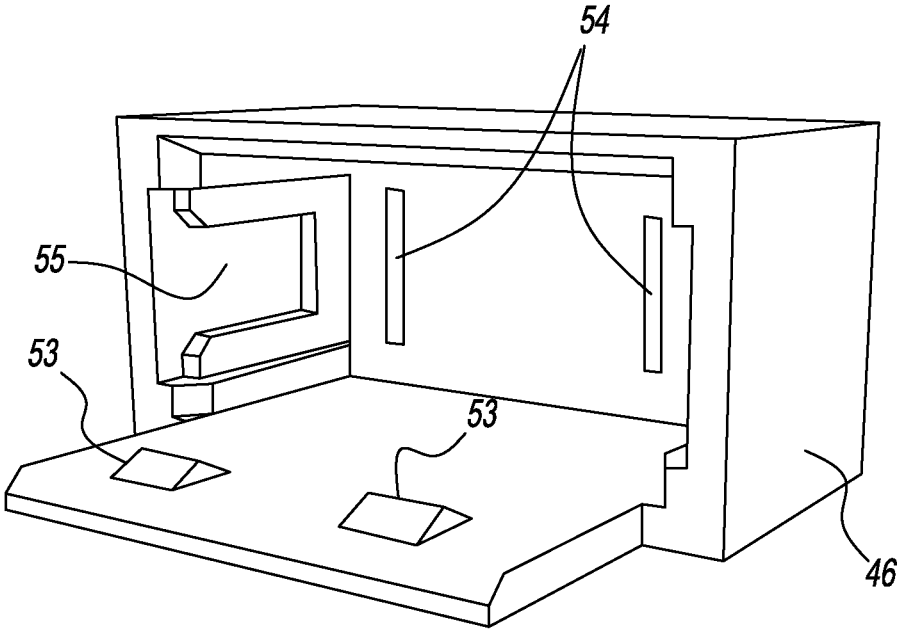
FIG. 11 is a perspective view showing the inside of a hoop-securing clip for a first handheld waste collection tool embodiment.

FIG. 11 is a detailed view of the open end (interior) of one embodiment of clip 46 for holding the hoop securely in place. Protrusions 53 are shown, which correspond to various notches 51 on the body of the tool. The mating protrusions and notches in alternative embodiments may be any functionally mating shapes. For example the protrusions could be cylindrical and the notches cylindrical impressions, the protrusions pyramids and the notches pyramidal depressions, etc. Also, the position of the notches and protrusions may be swapped, with the protrusions on the body and notches in the clip. The hoop passes through holes 54. Groove 55 provides space for the pivot 47, which may stick out from the side of the tool 1, when the clip is holding the hoop in the extended position, and fits closely around the pivot for added stability.

Figure 12:
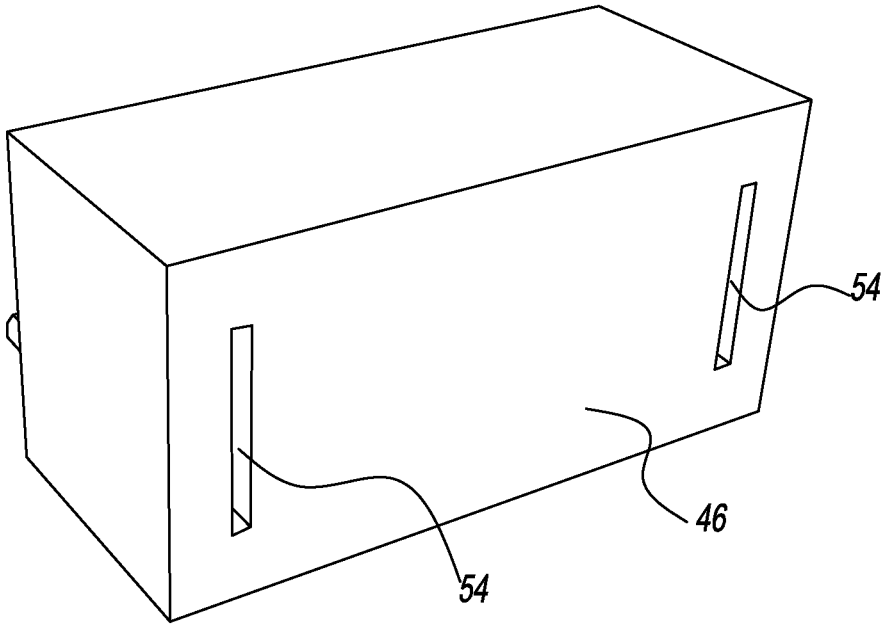
FIG. 12 is a rear perspective view showing a hoop-securing clip for a first handheld waste collection tool embodiment.

FIG. 12 is a detailed view of the exterior of clip 46 which depicts holes 54 where the hoop is inserted.

In a second embodiment, illustrated in FIGS. 13-29, the tool 101 has a retractable ovular hoop 103. The top of the body 155 has a clip 107 to hold a bag in place once put through the open hoop. Grooves or tracks 115 on either side of the body allow for the flexible hoop portion to slide into open and closed positions. The retractable hoop is a thin flexible metal or plastic band that is in this embodiment ¾" wide. In other embodiments, the body is cylindrical, a triangular prism, or the like, and there is no clip for holding the bag as a user can hold the bag in place with a finger or separate, removable clip or fastener.

In this second embodiment, in the closed position, the hoop lies flat along the side of the body with the grooves or tracks 115 on each side of the rectangular prism-shaped body. For use, the hoop extends and slides out of the grooves, forming an open ovular ring attached to the body. When the ovular hoop is extended a bag is placed through the hoop.

Figure 13:
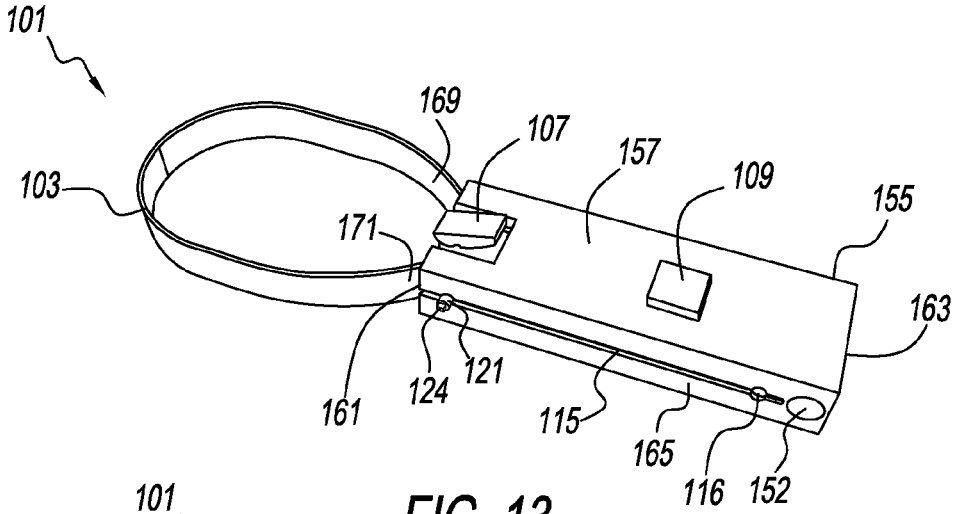
FIG. 13 is a top perspective view of a second embodiment of a handheld animal waste collection tool with a hoop in an open position.
Figure 36:
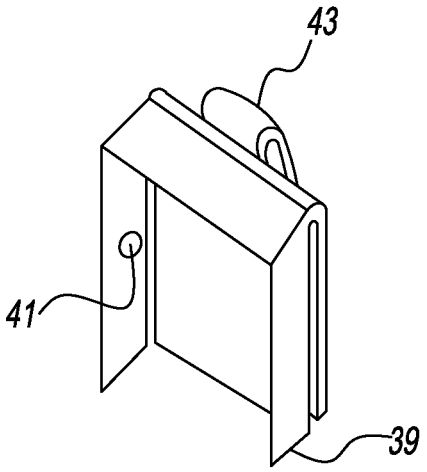
FIG. 36 is a front perspective view of a second embodiment of a carrying sleeve for a handheld animal waste collection tool.
Figure 37:
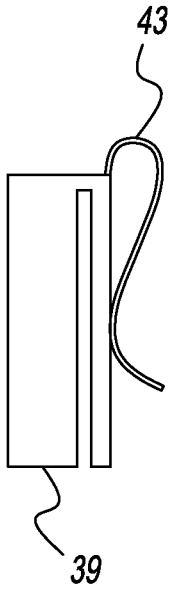
FIG. 37 is a side view of a second embodiment of a carrying sleeve for a handheld animal waste collection tool.
Figure 38:
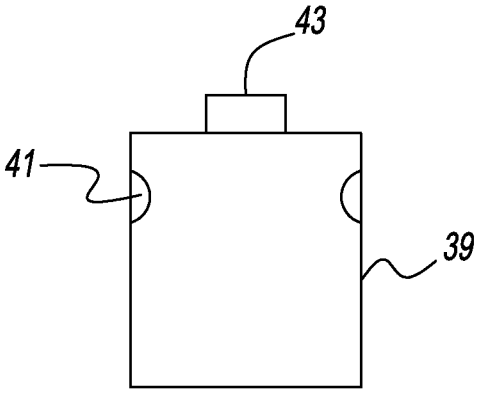
FIG. 38 is a front view of a second embodiment of a carrying sleeve for a handheld animal waste collection tool.

FIG. 13 is a top perspective view of a handheld animal waste collection tool 101 in a second embodiment with a hoop 103 in an open position. Sliders 121 and grooves 115 allow the hoop 103 to be retracted and extended along the sides of the tool 101. Clip 107 is for securing bags 104 inserted through the open hoop 103 and dispenser 109 allows bags to be withdrawn from the bag storage area inside the tool as shown in FIG. 8. Notches 152 allow for one embodiment of a carrying tool, for example as shown in FIGS. 36-38, to be attached to the body.

FIG. 13 is a top perspective view of a handheld animal waste collection tool 101 having a grippable housing 155 and an adjustable hoop 103 shown in an extended position, the hoop used to fit a flexible bag 104 for the collection of animal waste. The grippable housing is a rectangular hollow body 155 having a planar top wall 157 and a planar bottom wall 159, a front sidewall 165 and a rear sidewall 167 and a left sidewall 161 and a right sidewall 163. The front and rear sidewall have a lateral length that is relatively longer than a lateral length of the left and right sidewall. The front sidewall has a track 115 disposed across a substantial portion of the lateral length with a slider 121 disposed therein and attached to the adjustable hoop 103 and a notch 152 disposed on a right side portion of the front sidewall.

The planar top wall has a centrally disposed dispenser opening 109 and a clip 107 disposed on a left side portion of the planar top wall. The clip 107 operates to secure bags by using a spring force to press the edge of the bag between clip faces or between the clip and the body 155. A user presses down on the back of the clip 107 to create an opening for insertion of the bag. The adjustable hoop 103 is movable between a retracted position shown in FIG. 14 and the extended position of FIG. 13.

In the extended position of FIG. 13, the hoop 103 is substantially extended and exposed away from the grippable housing 155. In the extended configuration, the hoop in combination with the left sidewall 161 of the body substantially forms a completed ring shape. The hoop extends outwardly from gaps 118 in the left sidewall (FIG. 16), which is the entrance to the spaces 117 between the grooves or tracks 115 and the rest of the body 155, with a first arm portion 169 of the hoop extending from the rear side groove 115 and a second arm portion 171 of the hoop extending from the front side groove. In the extended position, a portion of the hoop remains stored within the space 117. As described below with regard to FIGS. 16-26, the slider button 121 is manipulated by a user to move the hoop between the extended position where the ring is formed and a retracted position, where most of the hoop is stored within space 117 for compact storage and transportation.

Figure 14:
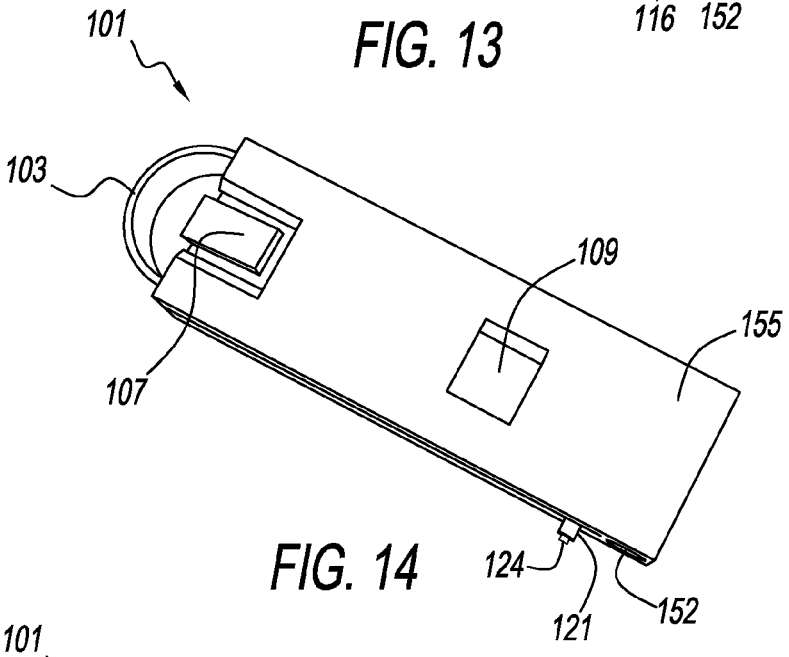
FIG. 14 is a top perspective view of a second embodiment of a handheld animal waste collection tool with a hoop in a closed position.

FIG. 14 is a top perspective view of a handheld animal waste collection tool 101 with hoop 103 a in a closed position. Here, the slider has been slid all the way back along the groove in the side of the tool, pulling the hoop 103 tight to the body of the tool.

Figure 15:
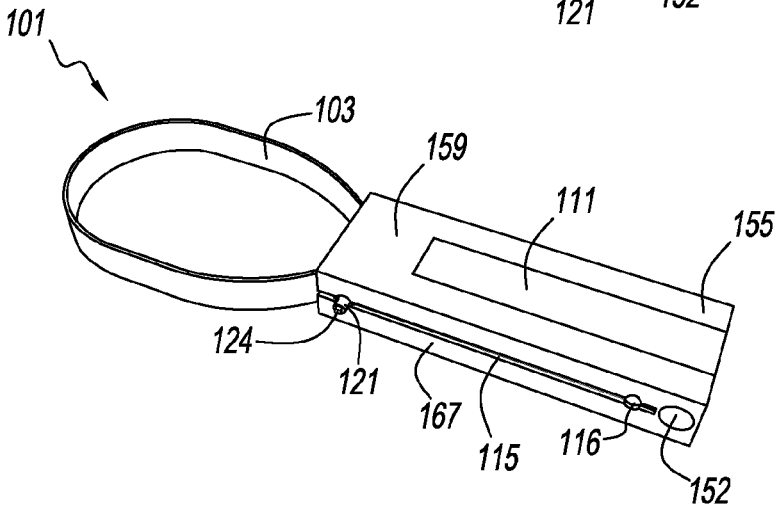
FIG. 15 is a bottom perspective view of a second embodiment of a handheld animal waste collection tool with a hoop in an open position.

FIG. 15 is a top view of a handheld animal waste collection tool 101 with a hoop 103 in an open position. Here, the bag compartment cover 111 is visible. Bags are inserted into the bag storage compartment through this cover 111. FIG. 15 illustrates an embodiment with flexible retractable band in side grooves, FIG. 9 illustrates a corresponding embodiment with rotatable hoop.

Figure 16:
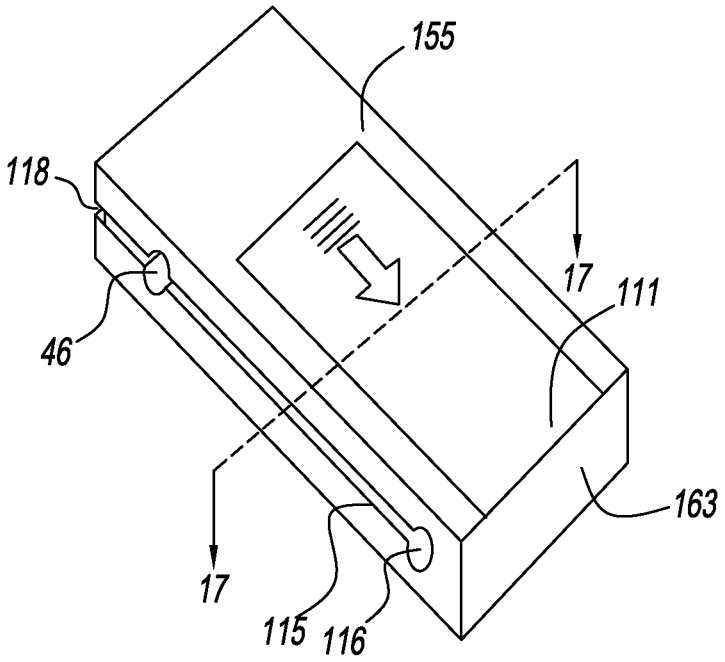
FIG. 16 is a bottom perspective of a second embodiment of a handheld animal waste collection tool with no hoop.
Figure 17:
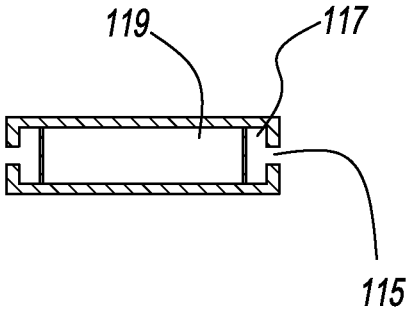
FIG. 17 is a cross-section view of a second embodiment of a handheld animal waste collection tool with no hoop.
Figure 18:
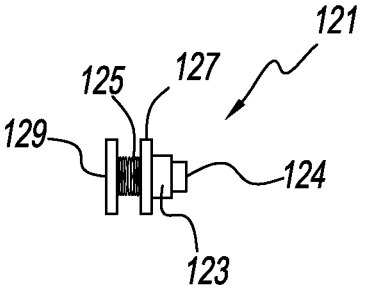
FIG. 18 is a detail of a compression button.

FIG. 16 is a perspective view of a handheld animal waste collection tool 101 with no hoop and FIG. 17 is a corresponding section view. Here the groove 115 in the side of the tool 101 is seen. The sides 115 of the tool extend away from the main body 119 that contains the bags, creating a gap 117 between the body 119 and the side and groove 115 in which a slider is introduced. A compression button 121 forms a part of the slider system in the illustrated embodiment. FIGS. 18 and 21-25 illustrate details of a compression button 21. Spring 125 is sandwiched between flat pieces of plastic 127, 129. The flat piece of plastic 127 corresponds in shape to side openings 116, while flat piece of plastic 129 is larger than the side openings 116 and will not fit through them. The width between the two pieces 127,129 when the spring is not compressed is greater than the width of the gap 117.

To insert the compression button 121 into the gap 117, the flat piece 129 is inserted into the front gap opening 118 as the user presses on nub 123, compressing the spring 125 until flat plastic piece 127 and nub 123 can also fit into the opening 118. An extension 124 on nub 123 does fit into the groove 115, while the flat plastic pieces 127,129 and nub 123 do not, so at that point the compression button 121 can be slid along the groove 115 and the spring no longer needs to be compressed by the user. The extension can have any cross-section that fits within the groove. An extension with a circular cross section provides a higher tolerance in case the compression button becomes slightly twisted or displaced, while a rectangular extension allows for a longer extension that may be easier for a user to locate by feel and manipulate. The spring 125 exerts a force on the plastic piece 127, however the plastic piece 127 will not fit through the groove and is trapped in the gap 117.

When the compression button 121 reaches a side opening 116, the spring force pushes the nub 123 out of the opening. The flat piece 127 is wider than the groove 115, locking the compression button in position when a side opening 116 is reached. The spring 125 must be compressed by the user to depress the nub 123 below the level of the groove 115 and move the button 121 from this position. Initial assembly is performed at the factory, and during typical operation a user does not need to entirely remove the band or reinsert it, but merely slides the band between the extended and retracted positions by moving the buttons 121 between the side openings 116.

Figure 32:
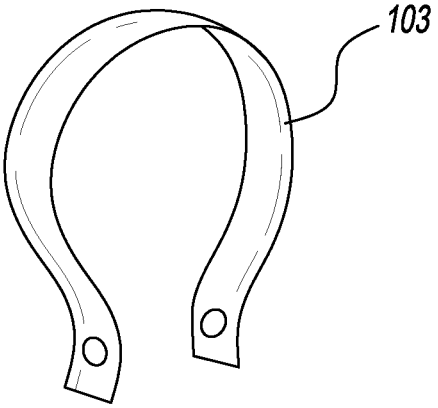
FIG. 32 is a perspective view of a hoop without sliders.

The side portion of the hoop 103 has a hole into which the nub 123 is inserted as shown in FIG. 32, and which is positioned on the flat piece 127 and inside the gap 117.

Figure 19:
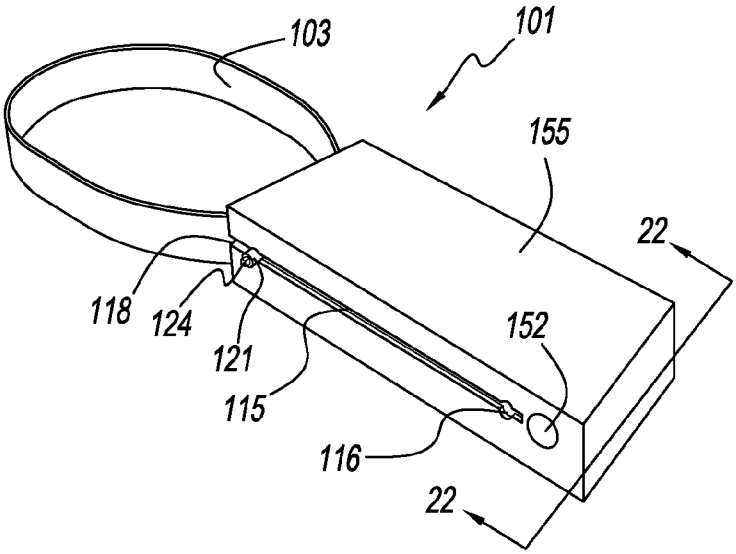
FIG. 19 is a bottom perspective view of a second embodiment of a handheld waste collection tool.
Figure 20:
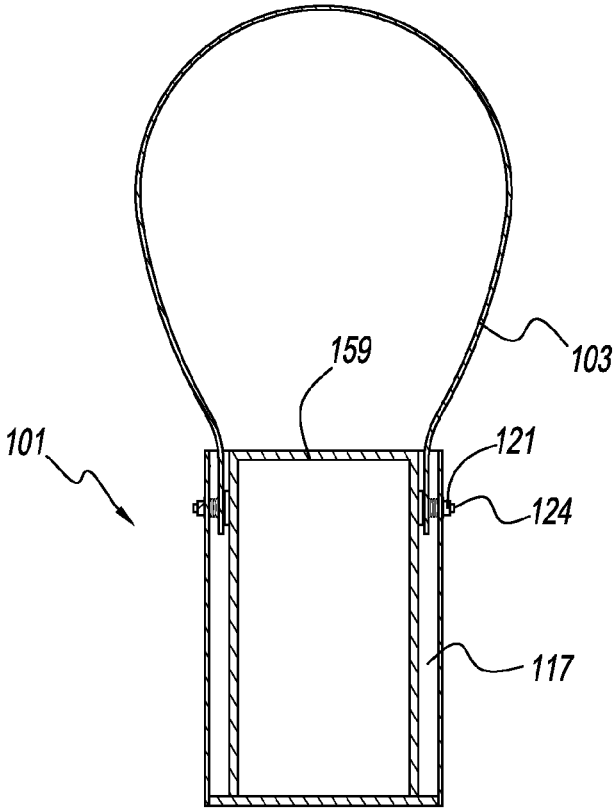
FIG. 20 is a section view of a handheld animal waste collection tool with compression buttons sliders in locked open position.
Figure 21:
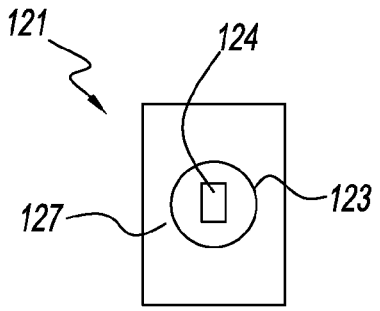
FIG. 21 is a top view of a compression button.
Figure 22:
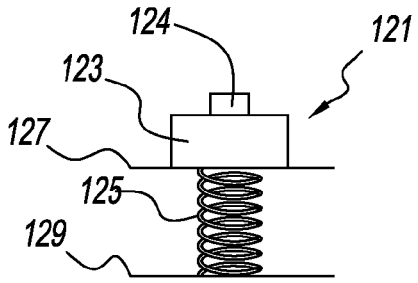
FIG. 22 is a side view of a compression button.
Figure 23:
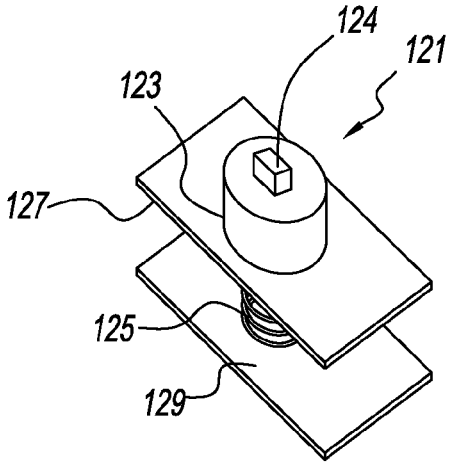
FIG. 23 is a perspective view of a compression button.
Figure 24:
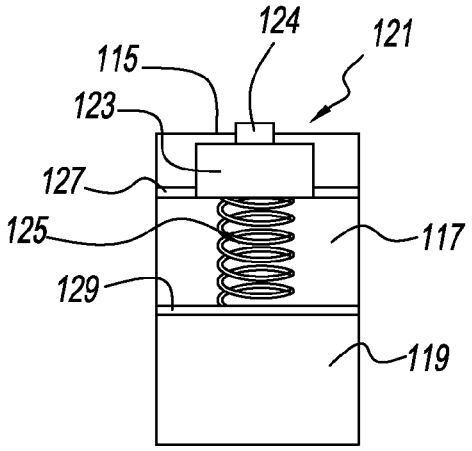
FIG. 24 is a side view of a compression button inside a gap and groove in a sliding position.
Figure 25:
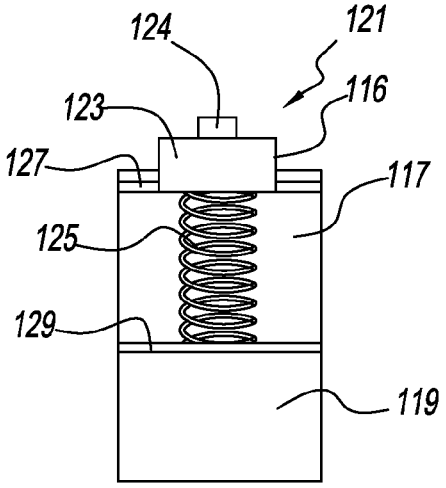
FIG. 25 is a compression button inside a gap in the held position of an opening.

FIG. 19 is a perspective view and FIG. 20 is an overhead section of a handheld animal waste collection tool with compression button sliders in locked open position, where compression button 121 is aligned with the front side opening 116. In an alternative embodiment, there is a groove on only one side of the handle body, however this necessitates a longer handle body to achieve the same hoop extension.

FIGS. 26-29 illustrate a new animal waste collection method, in which a bag 104 is placed through the hoop 103 of a handheld animal waste collection tool 101, with the open end of the bag on the top of the tool. The bag 104 is placed so that the middle of the bag is in the same plane as the hoop 103. One side of the top of the bag is clipped on to the top of the body of the tool. The other side (top of hoop end) is wrapped downwards around the hoop 103 until it is in line with the bottom of the bag.

The bag 104 is now in a position where the bottom half of the bag is creating a compartment for fecal matter and the top portion of the bag is wrapped around the hoop with the interior of the bag covering the outside of the hoop. When fecal matter is picked up by moving the hoop 103 with movement of the tool 101 by the user, the bag 104 falls through the hoop 103 so that the portion of the bag in contact with the poop/ground is now on the inside of the bag with the remaining fecal matter. The bag clip 107 (or e.g. a user's fingers) holds one side of the bag in place and prevents the bag from falling completely through the hoop 103. The tool 101 and outside of the bag remain clean as they never contact the fecal matter during the pick up process. The bag 104 can then be tied off and discarded, or carried with the tool to a disposal location and discarded, without risking contact with fecal matter.

Figure 26:
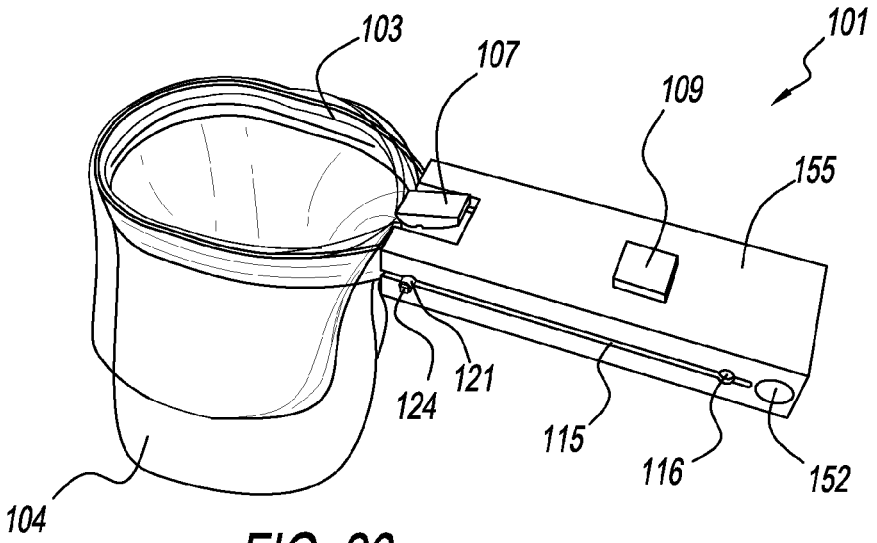
FIG. 26 is a top perspective view of a second embodiment of an animal waste collection tool with a bag inserted into the hoop.

FIG. 26 is a top perspective view of a second embodiment of an animal waste collection tool with a bag 104 inserted into the hoop 103 and secured by clip 107. Here, the bag 104 is pulled over the hoop 103 such that the top of the bag is nearly level with the bottom.

Figure 27:
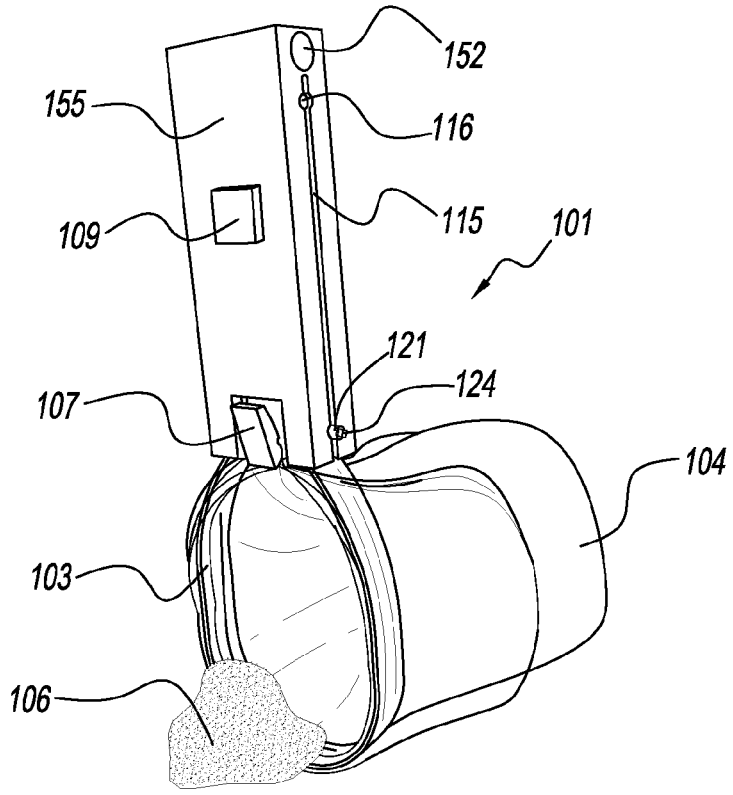
FIG. 27 is a perspective view of a second embodiment of an animal waste collection tool with a bag inserted into the hoop positioned for collection of animal waste.

FIG. 27 is a perspective view of a second embodiment of an animal waste collection tool with a bag 104 inserted into the hoop 103 positioned for collection of animal waste 106 by scraping the hoop 103 along the surface the animal waste 106 is resting on.

Figure 28:
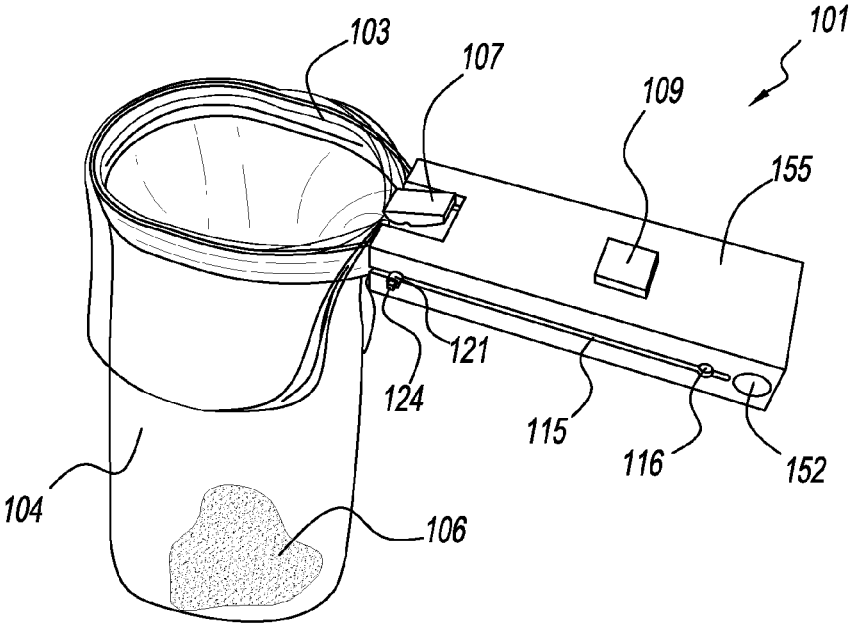
FIG. 28 is a perspective view of a second embodiment of an animal waste collection tool with a bag inserted into the hoop and animal waste collected in the bag.

FIG. 28 is a perspective view of a second embodiment of an animal waste collection tool with a bag 104 inserted into the hoop 103 and animal waste 106 collected in the bag. The weight of the animal waste 106 is drawing the bag 104 through the hoop 103, and the bottom of the bag is now well below the top.

Figure 29:
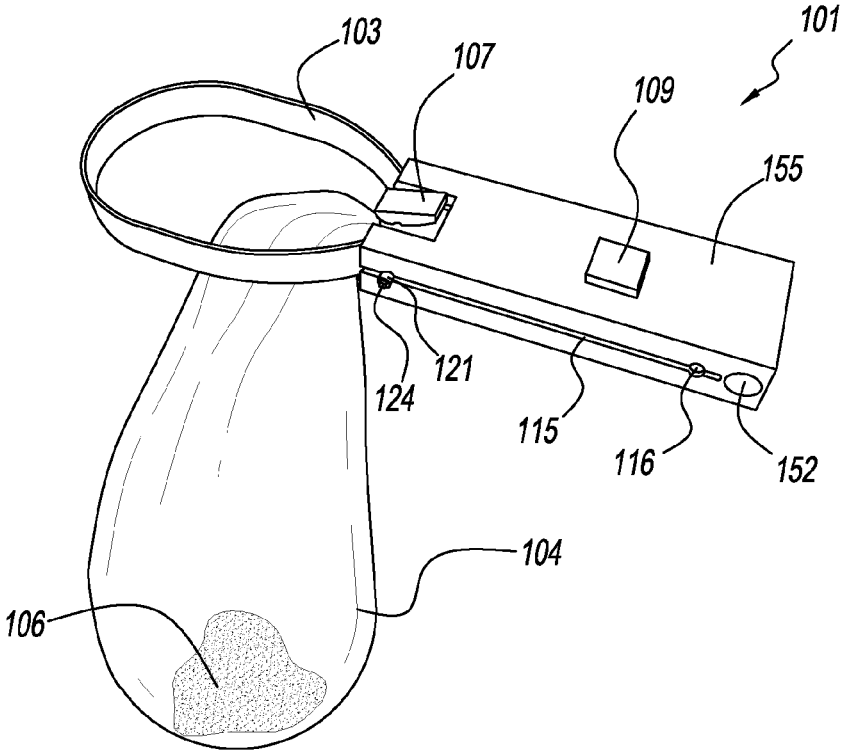
FIG. 29 is a perspective view of a second embodiment of an animal waste collection tool with a bag inserted into the hoop and animal waste collected in the bag and pulling the bag off the hoop.

FIG. 29 is a perspective view of a second embodiment of an animal waste collection tool with a bag 104 inserted into the hoop 103 and animal waste 106 collected in the bag 104 and pulling the bag off the hoop 103 such that it hangs from the clip 107 for easy removal, closure and disposal.

Figure 30:
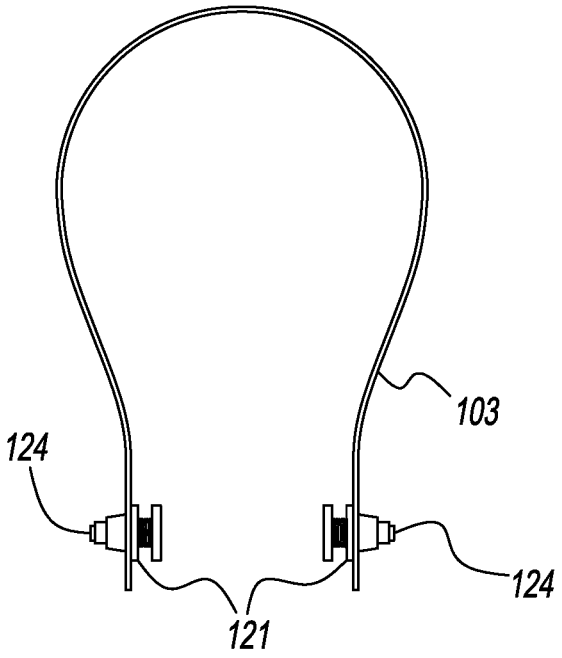
FIG. 30 is a top view of a hoop with compression button sliders.
Figure 31:
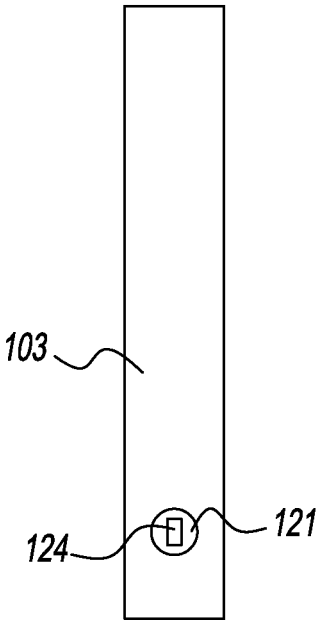
FIG. 31 is a side view of a hoop with compression button sliders.

FIG. 30 is a top view and FIG. 31 is a side view of a hoop 103 with compression button 121 sliders. FIG. 32 is a perspective view of a hoop 103 without sliders.

Figure 33:
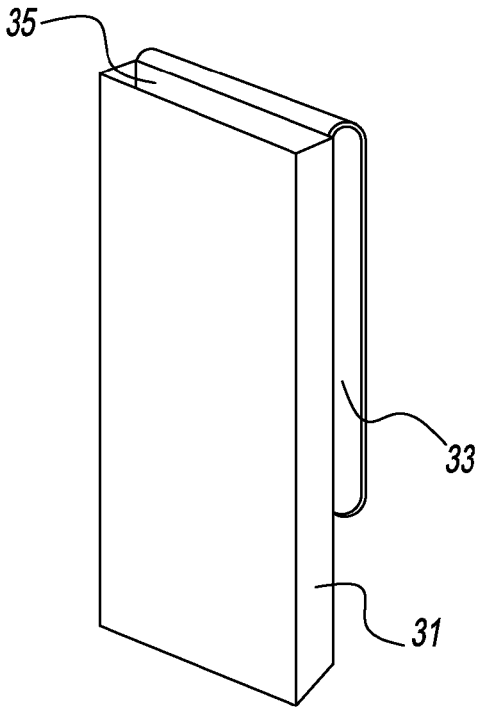
FIG. 33 is a front perspective view of a first embodiment of a carrying sleeve for a handheld animal waste collection tool.
Figure 34:
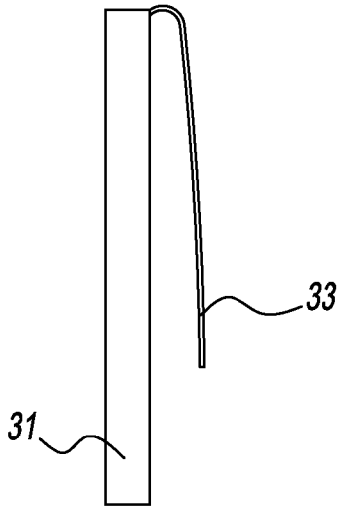
FIG. 34 is a side view of a first embodiment of a carrying sleeve for a handheld animal waste collection tool.
Figure 35:
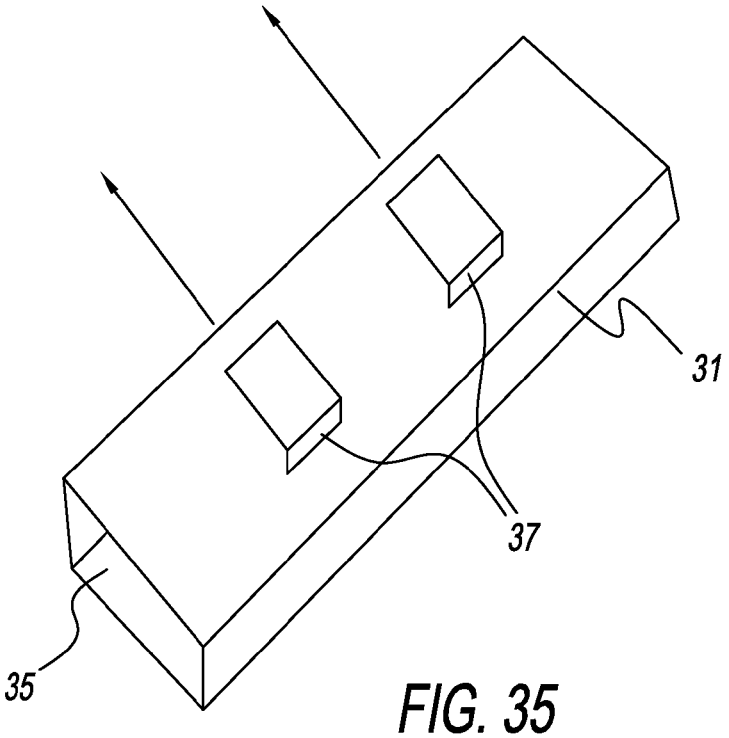
FIG. 35 is a rear perspective view of a first embodiment of a carrying sleeve for a handheld animal waste collection tool.

There are many different embodiments of carrying devices/sleeves for easily carrying and transporting handheld animal waste collection tools. Examples of such designs include a fabric sleeve with elastic sides and a plastic clip attaching directly to the tool body, shown in FIGS. 33-35. The fabric sleeve 31 is in roughly the same shape as the tool, as shown a rectangular prism, with an opening 35 on one end through which the tool is slid downward into the sleeve. The sleeve is slightly smaller than the tool so as to hold the tool in place via the elastic sides. This sleeve is attached to a dog leash via clips 37 on the bottom (long rectangular portion) as shown in FIG. 35, or attached to a person's clothing via a clip or a flat piece of plastic 33 which can be inserted in a pair of shorts/pants.

Figure 39:
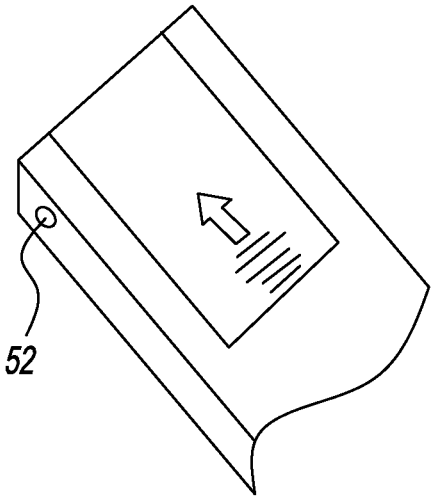
FIG. 39 is a perspective view of a portion of a handheld animal waste collection tool showing attachment points for a carrying sleeve.

In another design, a plastic clip attaches directly to the tool. One example of such a clip is shown in FIGS. 36-38 and utilizes circular side notches 52 built into the tool body as shown in FIG. 39. A plastic clip 39 that conforms to the shape of the tool contains protruding hemispheres (or similar) 41 that slide into the circular notches 52 located on the tool to hold the clip 39 to the tool. The sides of the clip are flexible to allow for ease of removal and insertion while also maintaining a solid hold. This type of clip can also be held to a leash or a person's clothing via a clip 43 or a flat piece of plastic 40 which can be inserted in a pair of shorts/pants.

Figure 40:
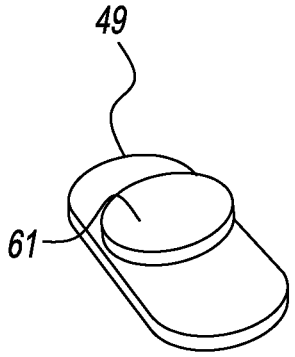
FIG. 40 is a top perspective view of an attachment piece for a belt clip for a handheld animal waste collection tool.
Figure 41:
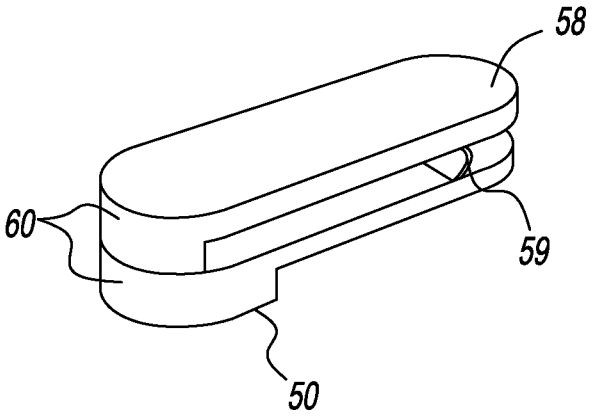
FIG. 41 is a top perspective view of a belt clip for a handheld animal waste collection tool.
Figure 42:
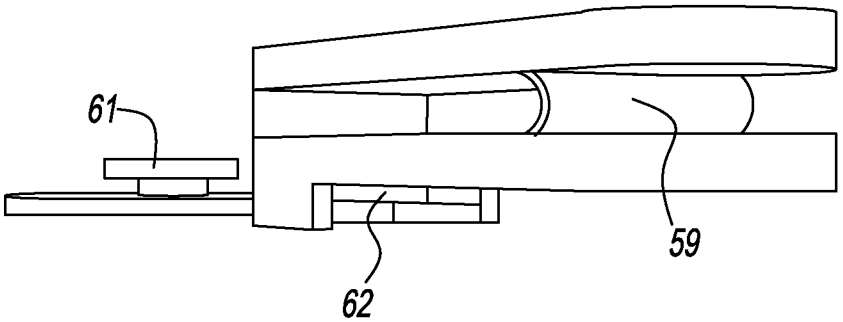
FIG. 42 is a perspective view of a belt clip and corresponding attachment piece for a handheld animal waste collection tool.
Figure 43:
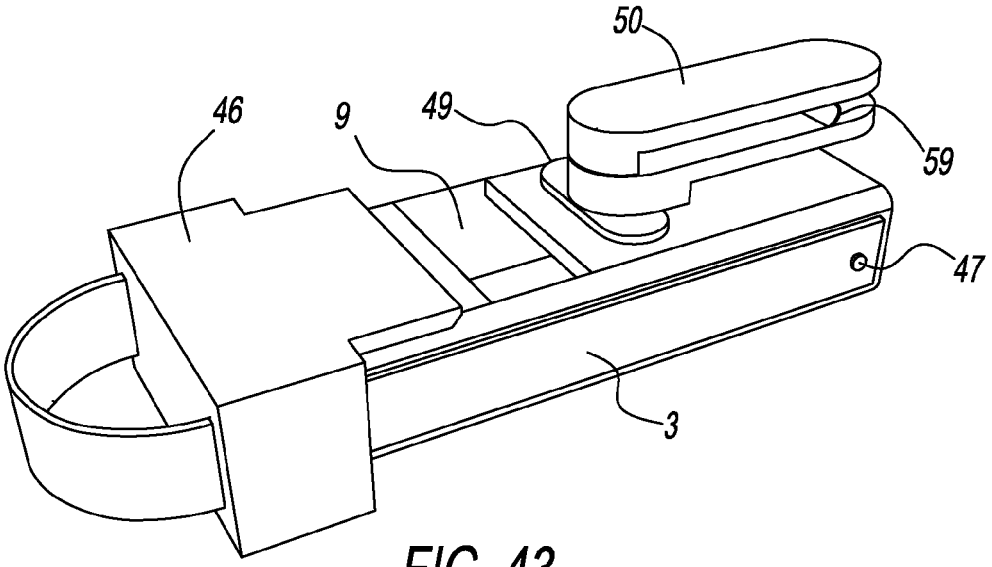
FIG. 43 is a view of a belt clip attached to a first embodiment of a handheld animal waste tool using an attachment piece.
Figure 44:
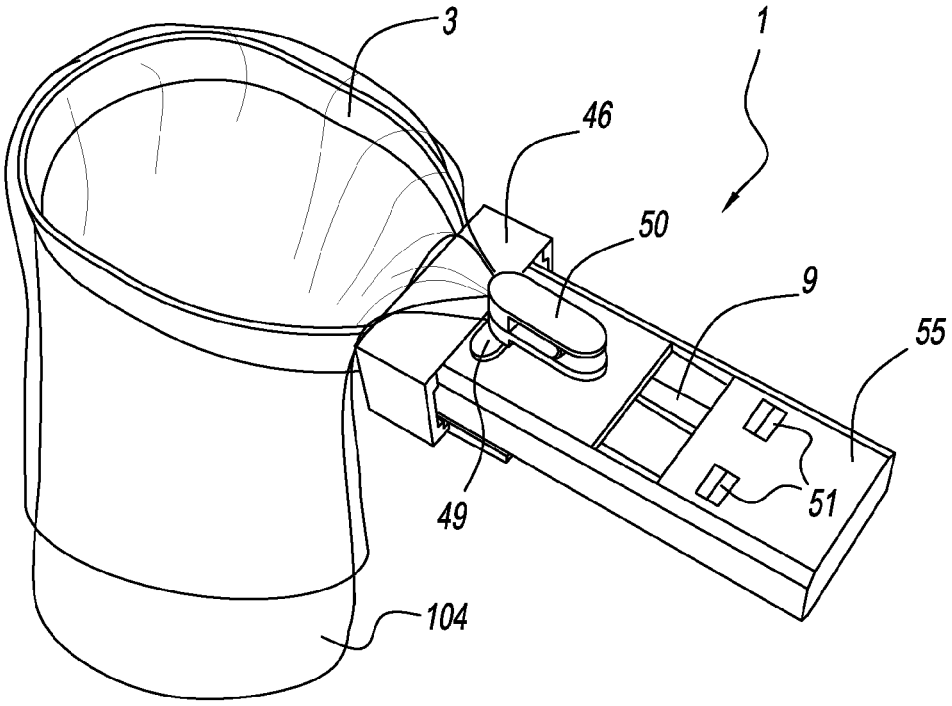
FIG. 44 is a top perspective view of a belt clip attached to a first embodiment of a handheld animal waste tool and used to secure a bag.

In some embodiments, a belt clip 50 is attached to the body of the apparatus for ease of carrying. This clip may also serve to hold the bag in place within the hoop. FIGS. 40-42 depict a belt clip 50 that can be attached to a handheld animal waste collection tool 1, 101 and used as a carrying device. Attachment piece 49 is attached directly to the body of the tool via an adhesive. Clip 50 can be attached and detached to/from piece 49 in various fashions, for example as shown in FIG. 42 by sliding the knob 61 of attachment piece 49 into a recess 62 in clip 50. The top back of the clip at 58 is pressed to create an opening at 60 where an article of clothing or bag is held in place. The clip is pressurized via a spring 59. An article of clothing can be inserted into the clip for carrying the tool and a bag can be inserted into the clip to secure it during operation. The clip can be removed to reduce the overall size of the tool and allow for alternate means of transport. FIG. 43 is a view of a belt clip 50 attached to a first embodiment of a handheld animal waste tool 1 using an attachment point 49. FIG. 44 is a top perspective view of a belt clip 50 attached to a first embodiment of a handheld animal waste tool 1 and used to secure a bag 104.

In some embodiments, the bag dispenser operates in a fashion similar to a tissue box, with the bags folded in such a way that as one bag is pulled from the dispenser, the next bag is drawn partially out of the dispenser for subsequent removal. The bags can be pre-folded in this fashion (similar to baby wipes) and simply inserted into the tool in a stack. Such stacking and folding is well known. In some embodiments, the bag dispenser accommodates roll-style bags (cylindrical rolls of bags) as shown in FIG. 8. In some embodiments, the hoop is a diamond or half-moon shape, or another shape useful both for scraping an object off the ground and for holding a plastic bag or other appropriate container. In some embodiments, variously sized tools are used for variously sized pets. An example standard size is about 6" long, 2" wide and ¾" thick. An example small size is about 4" long, 1.5" wide and ¾" thick.

In addition to standard bags, in various embodiments different containers are used, such as paper, cloth, or plastic devices in cone or bag shapes. Any type of container may be used if it is of a size and flexibility that allows it to be mounted in the waste collection tool as described The invention is not limited to the particular embodiments described above in detail. Those skilled in the art will recognize that other arrangements could be devised, for example, using various body, hoop, and bag shapes and sizes with and without bag dispensers in various configurations. While the invention has been described with reference to specific illustrative embodiments, modifications and variations of the invention may be constructed without departing from the scope of the invention.

We claim:

1. A sanitary animal waste collection method, comprising:

rotating a length of material, being attached to a body, away from the body to form an opening for insertion of a container;

partially inserting the container having an inside and an outside through the opening;

securing the container to a fastener attached to the body;

pulling an upper portion of the container over a side of the length of material and down so that a front of the length of material is covered by the outside of the container;

collecting unsanitary waste in the container, the unsanitary waste having a weight which pulls the upper portion of the container back through the length of material and leaves the container hanging from the fastener through the length of material;

locking the length of material in an open or a closed position with a locking clip that the length of material extends through by mating the locking clip with the body; and moving the length of material from the closed to the open position by sliding the locking clip along the length of material away from the body, rotating the length of material away from the body, sliding the locking clip down the length of the length of material towards the body, and securing the locking clip to the body.

2. The sanitary animal waste collection method of claim 1, wherein the collecting unsanitary waste comprises scraping the ground with the length of material, thereby pushing unsanitary waste on the ground into the container.

3. A sanitary animal waste collection apparatus, comprising:

a body; and a hoop secured to the body by pivots and configured to rotate about the pivots between an extended position and a compact position;

wherein in the extended position the hoop extends outward from the body to form an opening in which a container can be inserted for collection of unsanitary waste and in the compact position the hoop is tight against the length of the body;

wherein the body has a hollow interior for receiving a plurality of containers.

4. The apparatus of claim 3, wherein the body further comprises a removable cover that when removed allows the plurality of containers to be inserted in the interior of the body and a dispensing opening that allows the plurality of containers to be dispensed from the body without removing the cover.

5. The apparatus of claim 3, wherein the opening is formed between the hoop and the body.

6. The apparatus of claim 3, further comprising a fastener on the body for securing the container inserted through the hoop.

7. The apparatus of claim 3, further comprising a hoop-holding clip attached to the body for holding the hoop in the extended or compact position.

8. The apparatus of claim 7, further comprising a first locking structure on the body and a corresponding second locking structure on the hoop-holding clip, wherein the first and second locking structures, when aligned, prevent easy movement of the hoop-holding clip.

9. The apparatus of claim 7, wherein the hoop extends through the hoop-holding clip.

* * * * *